United States Patent [19]

Pivit et al.

[11] Patent Number: 4,717,895

[45] Date of Patent: Jan. 5, 1988

[54] HIGH-FREQUENCY, HIGH-POWER WAVEGUIDE JUNCTION CIRCULATOR

[75] Inventors: Erich Pivit, Allmersbach im Tal; Wolfgang Hauth, Backnang; Günter Mörz, Ludwigsburg; Sigmund Lenz, Aspach, all of Fed. Rep. of Germany

[73] Assignee: ANT Nachrichtentechnik GmbH, Backnang, Fed. Rep. of Germany

[21] Appl. No.: 890,452

[22] Filed: Jul. 29, 1986

[30] Foreign Application Priority Data

Jul. 30, 1985 [DE] Fed. Rep. of Germany ..... 3527189

[51] Int. Cl.[4] ..... H01P 1/39

[52] U.S. Cl. ..... 333/1.1; 333/33

[58] Field of Search ..... 333/1.1

[56] References Cited

U.S. PATENT DOCUMENTS

| | | | |
|---|---|---|---|
| 3,466,571 | 9/1969 | Jansen et al. | 333/1.1 |
| 3,492,601 | 1/1970 | Omori | 333/1.1 |
| 4,254,384 | 3/1981 | Piotrowski et al. | 333/1.1 |

OTHER PUBLICATIONS

Okada et al. *A 100KW Waveguide Y-Junction Circulator for Microwave* Power Systems at 915 Mhz Jrnl. of Microwave Pwr. Sep. 1977, pp. 201–207.

IEEE Transactions on Magnetics, vol. Mag-17, No. 6, Nov. 1981, pp. 2957–2960.

*Primary Examiner*—Paul Gensler

*Attorney, Agent, or Firm*—Spencer & Frank

[57] ABSTRACT

A waveguide junction circulator for a high power application at a high operating frequency. The circulator includes a plurality of connecting waveguides, each of which has a standard height dimension corresponding to the operating frequency; a resonance cavity; a plurality of spaced and cooled, superposed metal plates covered with ferrite discs disposed in the cavity; a magnet disposed outside the cavity for generating a magnetic field oriented perpendicular to the ferrite discs and penetrating the cavity; and a plurality of junction arms each having one end communicating with the cavity and another end forming a connection with a respective one of the plurality of connecting waveguides. The circulator has a height dimension in its region penetrated by the magnetic field that is reduced by at least 20% compared to the standard height dimension of the connecting waveguides. Each connection presents a transition from the connecting waveguide to the junction arm that has a sudden change in cross section from the reduced height of the circulator to the standard height of the connecting waveguide. Reactance elements are provided in the junction arms to form multisection filters.

8 Claims, 3 Drawing Figures

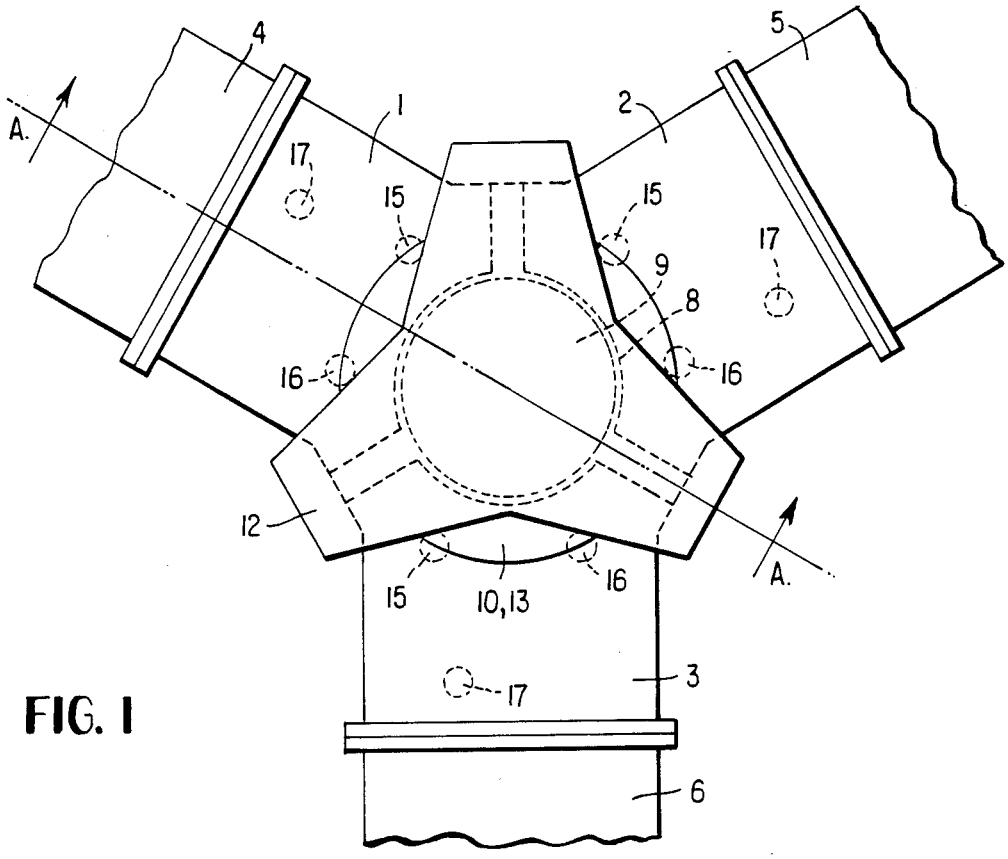
FIG. 1
FIG. 2
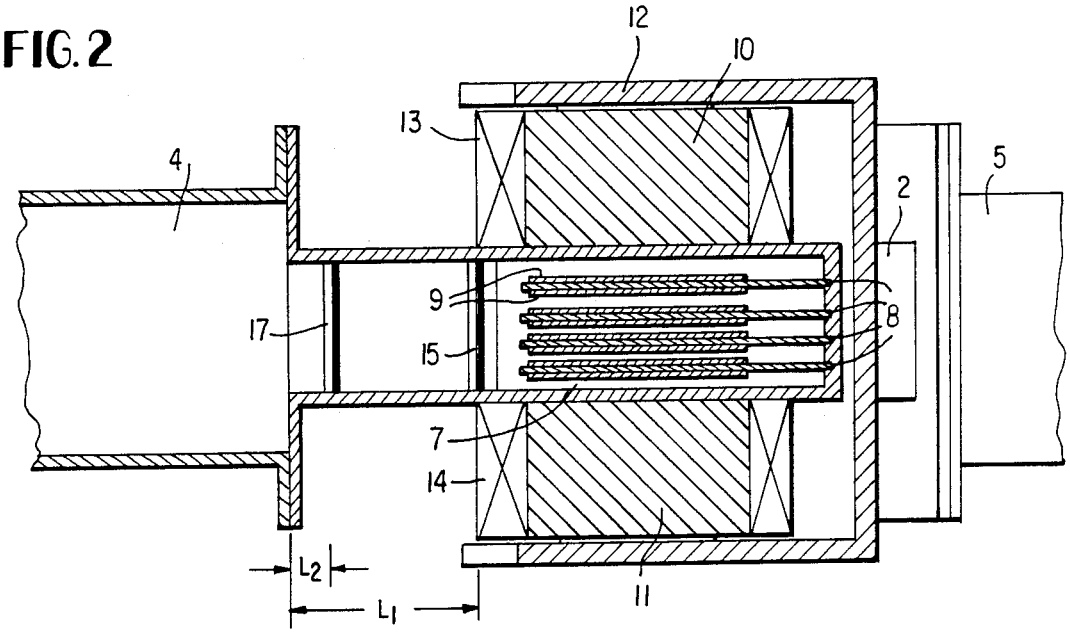

HIGH-FREQUENCY, HIGH-POWER WAVEGUIDE JUNCTION CIRCULATOR

BACKGROUND OF THE INVENTION

The present invention relates to a waveguide junction circulator designed for a high-frequency, high-power application and having a resonance cavity in which there is disposed a plurality of spaced and cooled superposed metal plates covered with ferrite discs and wherein outside the resonance cavity there is a magnet system which generates a magnetic field oriented perpendicularly to the ferrite discs.

Such a waveguide junction circulator is disclosed in *IEEE Transactions on Magnetics, Vol. Mag*-17, No. 6, November 1981, pages 2957–2960. This circulator is designed for a maximum high-frequency power of 250 kW at an operating frequency of 500 MHz and has a transmission loss of about 0.2 to 0.4 dB and a relatively narrow bandwidth of about 0.64% of the operating frequency so that the circulator reacts with great sensitivity to power fluctuations. Moreover, this prior art waveguide junction circulator has very large dimensions. It therefore requires an extremely high magnetic field which can be generated only with an expensive and large-volume electromagnet.

SUMMARY OF THE INVENTION

It is an object of the present invention to provide a waveguide junction circulator which is designed for a high-frequency, high-power application and which has the smallest possible structural size, requiring a less expensive, smaller volume magnet system.

The above and other objects are accomplished according to the invention by the provision of a waveguide junction circulator for a high-power application at a high operating frequency which includes a plurality of connecting waveguides each of which has a standard height dimension corresponding to the operating frequency; a resonance cavity; a plurality of spaced and cooled, superposed metal plates with ferrite discs disposed in the cavity; magnet means disposed outside the cavity for generating a magnetic field oriented perpendicular to the ferrite discs and penetrating the cavity; a plurality of junction arms each having one end communicating with the cavity and another end forming a connection with a respective one of the plurality of connecting waveguides, the circulator having a height dimension in its region penetrated by the magnetic field that is reduced by at least 20% compared to the standard height dimension of the connecting waveguides, each connection presenting a transition from connecting waveguide to junction arm that has a sudden change in cross section from the reduced height of the circulator to the standard height of the connecting waveguide; and reactance elements provided in the junction arms which form multiple section filters.

Due to the fact that, according to the invention, the height of the circulator is reduced, less metal plates covered with ferrite discs and less magnetization field are advantageously required which again requires a less expensive and less voluminous magnet system than known waveguide junction circulators. Due to the lower magnetization field required, it is even possible to use a permanent magnet which, in contrast to an electromagnet, does not consume energy.

The invention will now be described in greater detail with reference to an embodiment that is illustrated in the drawings.

BRIEF DESCRIPTION OF THE DRAWINGS

FIG. 1 is a plan view of a waveguide junction circulator according to the invention.

FIG. 2 is a longitudinal sectional view along line A—A of the waveguide junction circulator of FIG. 1.

DESCRIPTION OF THE PREFERRED EMBODIMENT

Figure 3:
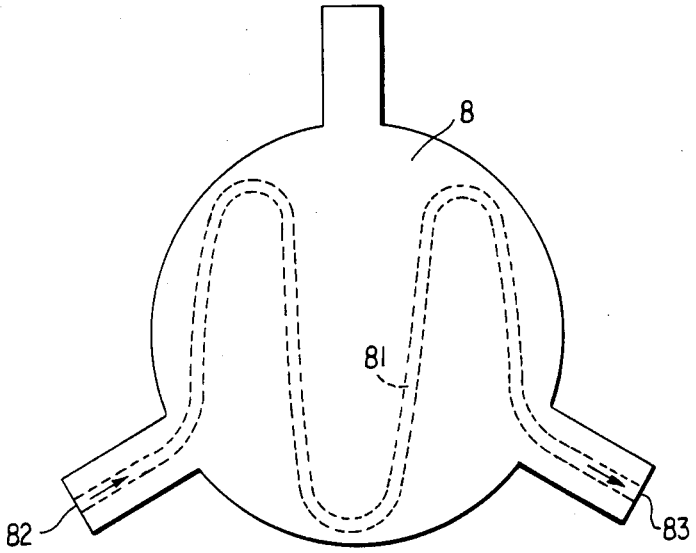
FIG. 3 is a plan view of a metal plate which is arranged in the resonance cavity of the circulator.

The waveguide junction circulator described herein is designed for a high-frequency power of more than 300 kW and an operating frequency of 500 MHz and serves, for example, to feed very high HF energy into the resonance cavities of a particle accelerator. Such a circulator decouples a high power klystron which produces HF power from a load so that the klystron will not be destroyed by reflected power components.

As shown in FIG. 1, such a waveguide junction circulator has three junction arms 1, 2 and 3 mutually offset from one another by 120° and connected with connecting waveguides 4, 5 and 6, respectively.

The internal structure and arrangement of the magnet system of the circulator is shown in FIG. 2 which is a sectional view of FIG. 1 along line A—A which passes through the longitudinal axis of junction arm 1.

In resonance cavity 7, from which arms 1, 2 and 3 branch out, four spaced metal plates 8 are arranged one above the other. These metal plates 8 serve as carriers for ferrite discs 9 attached to the upper and under sides of each plate. The ferrite material, which produces the non-reciprocal effect of the circulator, is divided into the plurality of thin discs 9 to maintain at a minimum the temperature gradient produced in the ferrite material by the high operating power. The division of the ferrite material into a plurality of thin discs has the result that the "effective filling factor" (ratio of the sum of the thicknesses of all ferrite discs to their total height of the cavity) is less than in conventional waveguide circulators for less power which have typical filling factors of 0.6 to 1.0. Since filling factor and bandwidth are proportional to one another, the realizable bandwidth for extremely high power circulators is generally less than for small signal circulators. The measures described in detail below, however, result in an increase in bandwidth.

To dissipate the heat produced in the ferrite discs, metal plates 8 are provided with cavities through which a coolant flows. A suitable ferrite material which is distinguished by a very low attenuation of 0.04 dB at 500 MHz has, for example, a saturation magnetization $4\pi M_s$ of about 1000 Gauss and a line width $\Delta H$ of about 20 Oersted. The ferrite discs 9 are each composed of a plurality of triangular segments which are glued onto metal plates 8, with small air gaps ($\approx 50\ \mu m$) remaining between adjacent segments.

The plates 8 are made out of brass. As shown in FIG. 3, a pipe (dotted lines) 81 winds though the interior of each plate 8, which has an inlet 82 and an outlet 83 for the coolout flowing through the pipe 81.

The material for the ferrite discs 9 is yttrium-iron-garnet.

Compared to connecting waveguides 4, 5 and 6 which have the standard dimensions for the operating frequency, the height of the junction waveguide circulator is reduced in a ratio of, for example, 0.6:1, but at least by 20% relative to the standard height for the operating frequency. This reduction in height of the circulator has the advantageous result that the number of metal plates 8 covered with ferrite discs 9 to be accommodated in resonance cavity 7 is reduced compared to a resonance cavity of standard height and that less magnetization field is required for the smaller resonance cavity 7 equipped with less ferrite discs 9.

The waveguides 4, 5 and 6 have a standard height of 228.6 mm and a standard width of 457.2 mm for the operating frequency 500 MHz.

The lower the magnetization field to be generated, the smaller in volume and the less expensive wil be the required magnet system. For that reason, the present circulator is able to operate with a permanent magnet which furnishes most of the magnetization field. As shown in FIG. 2, the permanent magnet is composed of two magnet cores 10 and 11 disposed above and below resonance cavity 7, respectively, with their magnetic flux being returned via a yoke 12. The two permanent magnet cores 10 and 11 are each surrounded by an electric coil 13 and 14, respectively. Electric coils 13 and 14 serve, on the one hand, to magnetize magnet cores 10 and 11 only after they have been mounted on the circulator, since mounting of premagnetized cores is very difficult due to the high magnetic forces involved. On the other hand, electric coils 13 and 14, together with cores 10 and 11, respectively, constitute an electromagnet whose magnetic field can be controlled as a function of the current flowing through the coils. In addition to the magnetizing field emanating from the permanent magnet, the electromagnet furnishes only a small proportion of the magnetization which is set at such a magnitude that changes in the scattering parameters of the circulator as a result of power fluctuations are compensated.

In dimensioning the circulator, it is necessary to consider, on the one hand, the high-frequency power to be transmitted (dielectric strength) and, on the other hand, the forward attenuation, so that optimum data can be realized. Initially a reduction in the height of the waveguide in the resonator region acts adversely on dielectric strength since the voltage intensity per unit height increases. Thus, a compromise has to be found between the minimum waveguide height and the maximum voltage compatibility.

The losses of a transmission resonator become smaller with decreasing external Q and thus the resonance step-up also decreases, which again increases voltage compatibility. These characteristics are utilized in the present case, i.e. the reduced height circulator is able to transmit the same power, if broadband transformation is employed, as the narrow band dimensioned circulator having the standard cross section.

With sudden changes in cross section at the transitions from the reduced height circulator junction arms 1, 2 and 3 to the connecting waveguides 4, 5 and 6 and several reactance elements installed in the junction arms, multi-section filters can be realized which produce a very broadbanded matching of the circulator junction arms to the connecting waveguides. Suitable reactance elements are constituted by inductively acting posts 15, 16 and 17 which extend between the broadsides of the junction arm waveguide because they are easily adjustable and are able to withstand very high field intensities. An optimum configuration of inductive posts with which a very high bandwidth (about 6% of the operating frequency with return or isolation loss of more than 20 dB) and attenuation of $<0.1$ dB was realized with the configuration, as shown in FIG. 1, of two juxtaposed posts 15, 16 which are each spaced by $L_1 \approx 0.46\lambda$ from the sudden change in cross section and a post 17 spaced at $L_2 \approx 0.11\lambda$ from the sudden change in cross section, as shown in FIG. 2, where, $\lambda$ is the wavelength corresponding to the operating frequency of the circulator.

As indicated by these data, the bandwidth of the present circulator has been increased by a factor of 10 and the attenuation has been reduced from 0.2 to 0.4 dB to $<0.1$ dB when compared with prior art circulators.

The resonance cavity 7 and the junction arms 1, 2, 3 have a height of 136 mm at an operating frequency of 500 MHz and a high-frequency power of 300 kW.

The posts 15, 16 and 17 have a diameter of 30 mm and the spacing between the posts 15 and 16 is $0.32 \cdot \lambda$, with $\lambda = 60\ \mu m$ at an operating frequency of 500 MHz.

The present disclosure relates to the subject matter disclosed in Federal Republic of Germany, P No. 35 27 189.2 of July 30th, 1985, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A waveguide junction circulator for a high power application at a high operating frequency, comprising:

a plurality of connecting waveguides each of which has a standard height dimension corresponding to the operating frequency;

a resonance cavity;

a plurality of spaced and cooled, superposed metal plates and ferrite discs covering said plates disposed in said cavity;

magnet means disposed outside said cavity for generating a magnetic field oriented perpendicular to said ferrite discs and penetrating said cavity;

a plurality of junction arms each having one end communicating with said cavity and another end forming a connection with a respective one of said plurality of connecting waveguides, said circulator having a height dimension in its region penetrated by the magnetic field that is reduced by at least 20% compared to the standard height dimension of said connecting waveguides, each said connection presenting a transition from connecting waveguide to junction arm that has a sudden change in cross section from the reduced height dimension of said circulator to the standard height dimension of said connecting waveguide; and reactance elements provided in said junction arms which form multi-section filters.

2. Waveguide junction circulator as defined in claim 1, wherein the reduced height dimension of said circulator is 0.6 times the standard height dimension of said connecting waveguides.

3. Waveguide junction circulator as defined in claim 1, wherein said reactance elements comprise at least one inductively acting post disposed in each junction arm.

4. Waveguide junction circulator as defined in claim 1, wherein said magnet means comprises a permanent magnet and an electromagnet, with the permanent magnet furnishing a major portion of the required magnetic field required for operation of said circulator.

5. Waveguide junction circulator as defined in claim 4, wherein said electromagnet is controllable and compensates for power dependent changes in scatter parameters of said circulator.

6. Wave guide junction circulator as defined in claim 1 wherein said reactance elements form said multi-section filters with said sudden changes in cross section to provide broadband matching of said junction arms to said connecting waveguides.

7. In a waveguide junction circulator for a high power application at a high operating frequency including a waveguide housing defining a central resonant cavity and a plurality of junction arms, each having one end communicating with said cavity and another end forming a connection for a respective connecting waveguide of a standard cross-section corresponding to the operating frequency, a plurality of spaced and cooled, superposed metal plates covered by ferrite disks disposed in said cavity, and magnet means disposed outside said housing adjacent said cavity for generating a magnetic field oriented perpendicular to said ferrite disks and penetrating said cavity; the improvement wherein: said cavity and the inner dimensions of said junction arms have a height dimension which is reduced by at least 20% compared to the standard height dimension for said operating frequency; each said junction arm presents a sudden change in cross-section at the transition from the reduced height dimension of the junction arm to said standard height; and each of said junction arms is provided with reactance elements which, together with the respective said sudden change in cross-section, forms a multi-section filter which produces a broadbanded matching of the junction arm with a connecting waveguide of said standard cross-section.

8. A waveguide junction circulator as defined in claim 7 wherein said reduced height dimension is 0.6 times said standard height dimension at said operating frequency.

* * * * *